US007761216B2

(12) United States Patent
Norris et al.

(10) Patent No.: US 7,761,216 B2
(45) Date of Patent: Jul. 20, 2010

(54) APPARATUS AND METHODS FOR ACOUSTICALLY DETERMINING INTERNAL CHARACTERISTICS OF AN ENGINE AND THE LIKE

(75) Inventors: William Norris, Lovelock, NV (US); John A. Kleppe, Reno, NV (US); Dana R. McPherson, Reno, NV (US)

(73) Assignee: Board of Regents of the University and College System of Nevada, on behalf of the University of Nevada, Reno, Reno, NV (US)

( * ) Notice: Subject to any disclaimer, the term of this patent is extended or adjusted under 35 U.S.C. 154(b) by 1392 days.

(21) Appl. No.: 11/191,618

(22) Filed: Jul. 27, 2005

(65) Prior Publication Data

US 2007/0027607 A1 Feb. 1, 2007

Related U.S. Application Data

(60) Provisional application No. 60/591,736, filed on Jul. 27, 2004, provisional application No. 60/592,963, filed on Jul. 29, 2004.

(51) Int. Cl.
*G06G 7/70* (2006.01)

(52) U.S. Cl. ..... 701/100; 701/99; 701/103

(58) Field of Classification Search ..... 701/29, 701/100, 101, 99, 103; 705/8, 10; 707/104.1, 707/100; 703/8
See application file for complete search history.

(56) References Cited

U.S. PATENT DOCUMENTS 6,768,938 B2 * 7/2004 McBrien et al. ..... 701/100
7,013,210 B2 * 3/2006 McBrien et al. ..... 701/100
7,383,165 B2 * 6/2008 Aragones ..... 703/8

OTHER PUBLICATIONS

Schmidt, Ralph O., "Multiple Emitter Location and Signal Parameter Estimation," IEEE Transactions on Antennas and Propagation, vol. AP-34, No. 3, Mar. 1986, pp. 276-280.

Kleppe, John A., "Acoustic Pyrometry: A Historical Prospective," Proceedings—ISA 44$^{th}$ International Instrumentation Symposium, May 1988, pp. 504-512.

Sonbol, Assem, "Different Correlator Realizations," undated, pp. 1-5.

* cited by examiner

*Primary Examiner*—Richard M. Camby
(74) *Attorney, Agent, or Firm*—Klarquist Sparkman, LLP

(57) ABSTRACT

Apparatus and methods are disclosed for determining internal engine characteristics using acoustic-vibration data. Exemplary such data are passive acoustic pyrometer data. Acoustic-vibrational frequencies emanating from a running engine are detected and compared to frequencies having known relationships to particular operating characteristics of the engine. In an example, the dominant frequency or other prominent frequency emanating from an internal-combustion chamber of a turbine engine is detected and used to determine the fuel-to-air ratio in the chamber. The determined data are used for performing adjustments or optimizations of engine performance, such as adjusting the fuel-to-air ratio as required or desired. In a similar manner, operating characteristics of other engines or engine-like environments, including furnaces and boilers, can be determined.

56 Claims, 10 Drawing Sheets
(4 of 10 Drawing Sheet(s) Filed in Color)

APPARATUS AND METHODS FOR ACOUSTICALLY DETERMINING INTERNAL CHARACTERISTICS OF AN ENGINE AND THE LIKE

CROSS REFERENCE TO RELATED APPLICATION

This application claims priority from, and claims the benefit of, U.S. Provisional Application No. 60/591,736, filed Jul. 27, 2004, and U.S. Provisional Application No. 60/592,963, filed Jul. 29, 2004, both of which are incorporated herein by reference in their entirety.

FIELD

This disclosure is directed to, inter alia, methods and apparatus that utilize frequency or other vibrational data for determining an internal performance activity or operational characteristic of a mechanical system such as an engine, a boiler, or a furnace.

BACKGROUND

Gas-turbine engines (also generally termed "turbines") can be relatively clean, efficient, and less costly to construct than other power-generation alternatives and offer a blend of operational attributes that set them apart from the more traditional power-generation plants. Turbines generally include a compressor for pressurizing air and a combustor for mixing the pressurized air with fuel. Multiple flames within the combustor ignite the fuel-air mixture to generate a heated-gas exhaust. The heated-gas exhaust is passed into a turbine to generate power.

During turbine operation to generate power, the combustor flame burns constantly. An unintended termination of the combustor flame can occur, however, and is referred to as a "flameout." Flameout can occur, for example, if the fuel-to-air ratio is or becomes too rich or too lean to sustain combustion in the combustor.

To control fuel-to-air ratios at desired levels to prevent flameouts and other undesired consequences, turbine engines typically include controllers that commonly have employed a control strategy in which the fuel supply and the air supply to the turbine are separately controlled by reference to different measured turbine-performance parameters. For example, in a typical gas-turbine controller, fuel supply to the turbine is controlled primarily by a feedback loop that seeks to match the power output from the turbine with load demand on a power generator (e.g., electric-power generator) that is being driven by the turbine. This feedback is typically accomplished by monitoring the rotational speed of the turbine and by increasing or decreasing the fuel supply to the turbine to increase or decrease, respectively, the rotational speed as needed.

Other control systems have utilized the exhaust from the turbine for estimating fuel-to-air ratios in the combustor. These control systems typically examine the difference between turbine-exhaust temperature as measured and a reference-temperature value. A change in exhaust temperature causes the controller to change airflow to, and thus the fuel-to-air ratio within, the turbine combustor.

Because the types of adjustments summarized above are based upon post-combustion temperature of the exhaust from the turbine, these types of control mechanisms introduce a lag between exhaust-temperature assessment and correction of the fuel-to-air ratio based upon the assessment. This lag can present a particularly significant challenge in the event of a reduction in load demand. For example, if the magnitude of the change in load is sufficiently great, the control-system lag may cause one or more combustors in the turbine to experience flameout if the fuel-to-air mixture becomes too lean or too rich. If a sufficient number of combustors in the turbine experience flameout, the turbine may shut down and cease supplying power. Restarting the turbine often takes a substantial amount of time and effort, and the flameout/restart process can impose undesired thermal and mechanical wear on the turbine.

Similar concerns have also lead to complications in controlling fuel-to-air ratios in other combustor environments. Examples include boilers, furnaces, and other engines such as conventional internal-combustion engines, which are widely used in automobiles, trucks, motorcycles, and boats.

In conventional internal-combustion engines, for example, control devices are often used for assessing the oxygen content in the exhaust gas. For this purpose, oxygen-measurement probes have been used to provide a voltage signal corresponding to the partial pressure of oxygen in the exhaust gas. The voltage signal increases whenever the partial pressure of oxygen changes from excess oxygen to deficient oxygen in the exhaust, or vice versa. The output signals produced by the oxygen-measurement probes are evaluated by a controller that responds to changes in the partial pressure of oxygen by adjusting the fuel-to-air mixture. Thus, the controller assesses exhaust outside of the engine combustor as the controller seeks to determine or control activity occurring within the engine combustor. This post-combustion type of control system can introduce errors in making the assessment of oxygen content and can introduce time delays in effecting desired adjustments within the combustor based on the assessed oxygen content.

The fuel-to-air ratio usually is not the only aspect of concern in maintaining combustion in engines, furnaces, boilers, etc. Other concerns include providing efficient and reliable power generation while simultaneously seeking to minimize undesirable engine wear and noxious emissions from the combustion process occurring in the engine. Exemplary noxious emissions in the exhaust from a gas turbine include nitrogen oxides ($NO_x$), unburned hydrocarbons, carbon monoxide (CO), and other emissions. Controlling these undesirable emissions requires control of the fuel-to-air ratio of the combustible mixture being fed into the combustion chamber of the turbine.

One conventional approach to reducing noxious emissions from the turbine has been to configure the turbine such that, whenever the turbine is operating under a full-load condition, the fuel-to-air ratio entering the turbine has a particular equivalence ratio (i.e., the actual fuel-to-air ratio divided by a stoichiometric ratio of fuel to air that is based on theoretically complete combustion) that corresponds to a desired fuel-to-air point situated between the lean-flameout point (at which flameout occurs because the fuel-to-air ratio is too lean) and the rich-flameout point (at which flameout occurs because the fuel-to-air ratio is too rich). For reasons of reducing emissions and improving fuel economy, turbines are commonly operated with a fuel-to-air ratio of less than unity, i.e., a fuel-and-air mixture that is leaner than the stoichiometric fuel-to-air ratio. However, whenever the fuel-and-air mixture is too lean, carbon monoxide is produced, and whenever the fuel-and-air mixture is too rich, the exhaust includes unburned hydrocarbons, which is wasteful of fuel. Thus, accurate maintenance of predetermined fuel-to-air ratios within prescribed limits is important not only for controlling emissions of pollutants from the engine but also for operating the engine reliably without causing undue damage as noxious exhausts are minimized.

Background references include Kleppe, *Engineering Applications of Acoustics*, Artech Press, Boston, London, 1989, Kleppe et al., "The Application of Acoustic Pyrometry To Gas Turbines and Jet Engines," *Proceedings* 34*th AIAA/ASME/SAE/ASEE Joint Propulsion Conference*, Cleveland, 98-3611, pp 1-10, July, 1998; Kleppe, "Acoustic Pyrometry: A Historical Prospective," *Proceedings* 44*th International Instrumentation Symposium*, Reno, pp 504-512, May, 1998; Kleppe et al., "High Temperature Gas Measurements in Combustors Using Acoustic Pyrometry Methods," *Proceedings* 47*th International Instrumentation Symposium*, Denver, pp. 6-10, May 6-10, 2001; Verhage et al., "Damage of Hot Gas Components in Gas Turbines Due to Combustion Instabilities," *Proceedings ECOS*2000, Vol. 4, Eurotherm 66 and 67 Seminars, Universiteit Twente, 2000; and Schmidt, "Multiple Emitter Location and Signal Parameter Estimation," *IEEE Trans. Antennas Propogat*., Vol. AP-34, pp. 276-280, 1986.

SUMMARY

Applicants have invented apparatus and methods for assessing internal performance characteristics of an engine by determining the nature of or data concerning vibrations emanating from the engine. Example characteristics include fuel-to-gas (e.g., fuel-to-air or "fuel/air") ratio in a combustor, steam-to-air ratio in a boiler, flow rate in the industrial furnace associated with a steam engine, temperature in an internal combustion engine, and dangerous engine-operational conditions.

In preferred embodiments, the subject apparatus and methods yield determinations or estimates of a dominant frequency of a vibration, another frequency of a vibration, or data concerning another vibrational parameter produced by or emanating from the engine or its associated structure. From this determination or estimate, the subject apparatus and methods provide a quantitative assessment of the fuel-to-air ratio within the engine, e.g., the fuel-to-air ratio in a turbine combustor. The vibrational data may include harmonic data.

As used herein, the term "engine" encompasses any of various internal-combustion apparatus, boilers, combustors, furnaces, and other devices that produce work from action of a heated substance such as burning fuel, steam, or the like. Thus, for example, an exemplary engine can be a conventional internal-combustion piston engine, an internal-combustion turbine engine, a jet engine, or the like, or can be an engine that receives and utilizes a hot substance (e.g., steam) from an external source to produce work.

As used herein, the term "fuel" encompasses any of various substances that can be used as an energy source in an internal-combustion engine. Examples of fuels include solid fuels such as wood or coal, liquid fuels such as hydrocarbon fuels, and gaseous fuels such as hydrocarbon gases, hydrogen, etc.

As used herein, the term "air" (used in the context of fuel) encompasses any of various substances that must be added to a fuel to achieve combustion in an internal-combustion engine. Exemplary "air" substances include atmospheric air, oxygen gas, or other oxidizer substance.

In one embodiment, multiple microphones or other transducers are mounted to the housing or other component(s) of an engine. The microphones or other transducers are responsive to acoustic vibrations or other vibrations and, in one embodiment, generate and send corresponding electrical signals to a recording-and-computing device (as an exemplary controller). The recording-and-computing device analyzes the signals using, for example, a signal-classification or assessment algorithm, to produce data that are indicative of engine performance.

In one embodiment, the recording-and-computing device produces a sonogram from the received signals. The sonogram may be analyzed to determine the presence and nature of a dominant frequency or of another useful engine-diagnostic frequency. The dominant frequency or other useful frequency(ies) may be used for determining one or more aspects of internal performance of the engine, such as a fuel-to-air ratio in the combustor of an internal combustion engine.

In certain embodiments, autocorrelation or other correlation analysis can be performed on the vibration data and/or on disparate channels of such data, if available. For example, cross-correlation analysis can be performed on data from multiple vibration detectors and utilized to assess the fuel-to-air ratio in the combustors and the flow rates of the fuel-air mixture through a turbine or steam engine.

In certain embodiments, the MUSIC algorithm or other suitable algorithm can be used to identify the dominant frequency among various vibrations detected by microphones or other vibration-transducers. Data concerning the dominant frequency may be used, for example, for estimating the fuel-to-air ratio in a combustor or otherwise for controlling the fuel-to-air ratio.

The subject apparatus and methods may utilize a data array that is accessible to a recording-and-computing device. The data array may include, for example, data that reflect predetermined characteristics of one or more combustors of an engine operating under certain operating conditions. By way of another example, the data array may include the dominant frequency associated with each of a plurality of possible fuel-to-air ratios for a particular combustor. The recording-and-computing device can be used for comparing frequencies emanating from a combustor to the corresponding data in the data array. Thus, data concerning the internal characteristics of the combustor can be obtained from the determined frequencies emanating from the combustor. The data may also provide other information about the combustor or its operation, such as its efficiency, the nature of its effluent, and its operating temperature.

In one embodiment, the data array is developed empirically by pre-determining certain relationships of specific operating conditions, such as fuel-to-air ratios in a combustor, to specific dominant frequency(ies) or other acoustic or vibrational frequencies produced by the combustor during actual use. In other embodiments, one or more relationships between determined frequencies and the internal performance characteristics of the engine may be determined or estimated mathematically. Certain embodiments may also combine use of one or more data arrays with mathematical determination or estimation.

In one embodiment, the apparatus and methods use passive acoustic pyrometry for establishing a relationship between the operating conditions in a combustor and one or more frequencies emanating from the combustor. Alternatively or in addition, active acoustic-pyrometry methods may be used. "Active" acoustic pyrometry is performed using an extraneous acoustic source (transmitter) that supplies acoustic energy (generates a sound source) to the system being measured, and one or more acoustic detectors (receivers, e.g., microphones) "listens" to the system as the supplied acoustic energy interacts with the system. "Passive" acoustic pyrometry, on the other hand, involves the use of one or more receivers without a transmitter, wherein the receivers "listen" to the acoustic energy generated by the system itself. Active acoustic pyrometry may be used for generating additional data concerning certain performance characteristics of the engine.

In certain embodiments, after determining one or more performance characteristics of the combustor(s) or other portion of the engine, the operating parameters of the combustor(s) can be adjusted if necessary or desired. This responsive adjustment can be in real time and can be automated, as in an automatic feed-back system for governing engine performance. For example, the fuel-to-air ratio can be adjusted, during operation of the engine, by: (a) using a pump to increase the volumetric rate of fuel flow to the combustor(s); (b) reducing the flow of air entering the combustor(s); and/or (c) adding fuel using a centrifugal pump while increasing the air velocity of the particular volume of air driving the turbine, thereby increasing fuel added to the volume of air, if desired. The fuel-to-air ratio may be reassessed and further adjustments to fuel-to-air ratio made as desired or required.

Other aspects and advantages of the various embodiments of the subject apparatus and methods will become apparent as the specification proceeds, with reference to the accompanying drawings. It will be understood that the scope of the invention is not to be determined by whether the subject matter addresses all issues noted in the Background or includes all features or advantages noted in this Summary.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

In the following narrative various spatially orienting terms are used, such as "upper" and "lower." It will be understood that these terms are used for convenience of description with respect to orientation of the subject embodiment on, for example, a conventional reciprocating engine.

It also will be understood that, within this specification as noted above, the term "engine" encompasses turbine engines, conventional internal-combustion engines, steam engines, boilers, and furnaces.

Figure 1:
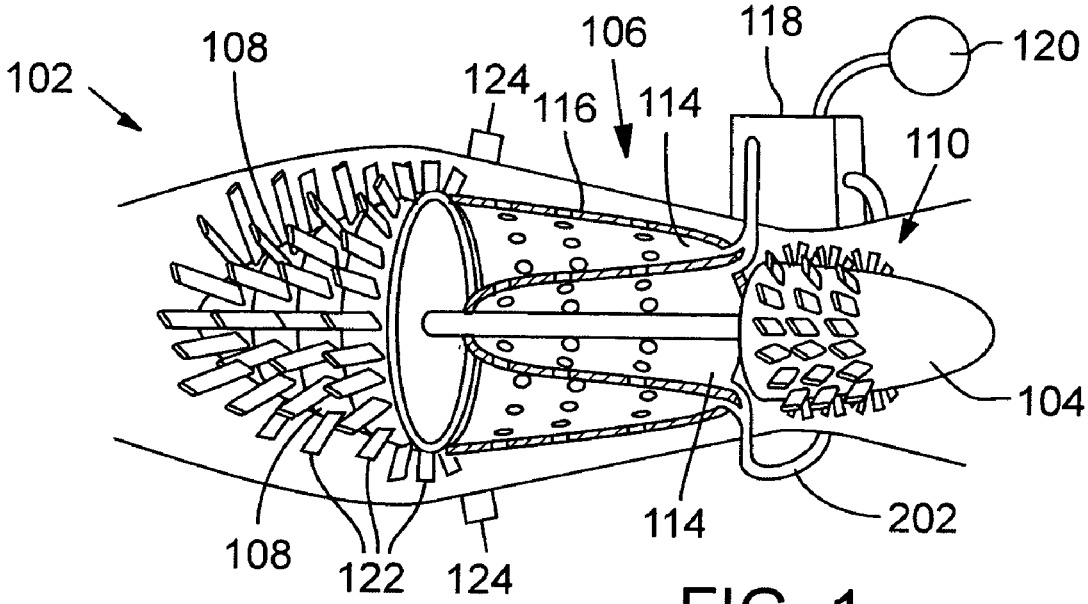
FIG. 1 is a view of certain aspects of a turbine engine (as an exemplary internal-combustion engine) that includes a representative embodiment of an apparatus for determining an internal performance characteristic of the turbine engine.
Figure 2:
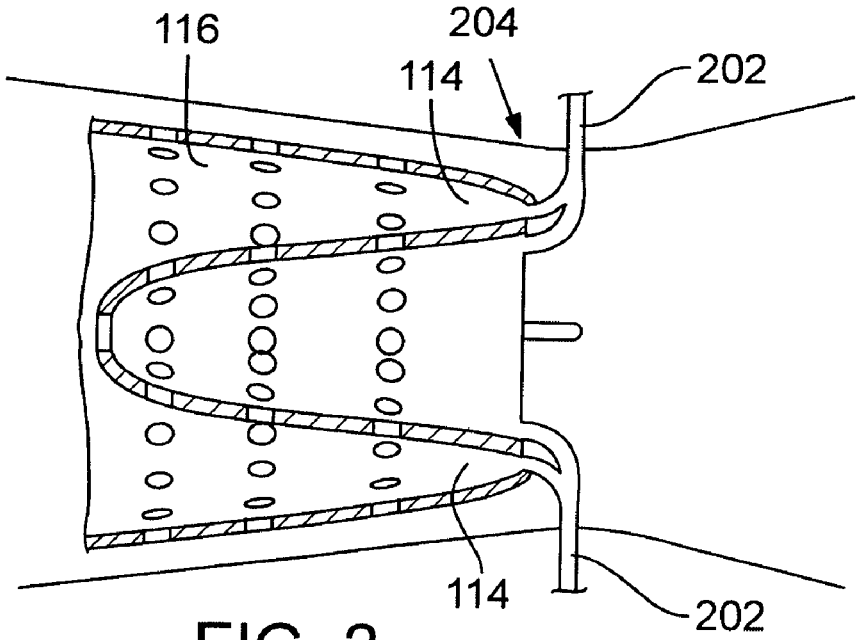
FIG. 2 shows details of a combustion zone of the turbine engine of FIG. 1.

With reference to FIGS. 1 and 2, a first representative embodiment is configured to measure an acoustic frequency produced by a gas-turbine engine 102 and to use the measured frequency to determine a ratio of fuel-to-air in the engine 102. The gas-turbine engine 102 includes three primary components: a compressor 104, a combustor 106 (also referred to herein as a "combustion zone"), and a plurality of turbines 108. The compressor 104 and turbines 108 rotate around a common axis. These components of the engine, namely the compressor 104, the combustor 106, and the turbines 108, are positioned along the common axis.

The compressor 104 is located at an upstream portion 110 of the engine 102 where air enters the engine 102 and is compressed. The combustion zone 106 is intermediate the compressor 104 and the turbines 108 and includes a flame holder 116 into which fuel is injected to cause a flame to burn constantly and generate heated exhaust.

Adjacent an entrance 204 to the combustor 106, fuel injectors 202 constantly inject atomized fuel into the flame holder 116, mix the atomized fuel with air, and inject the resulting mixture of atomized fuel and air into the combustor. Several burners 114 are used at the upstream end 204 of the flame holder 116 to constantly ignite the injected fuel-to-air mixture. The ignition and resulting burning of the fuel-and-air mixture generates heated exhaust gas that ultimately is discharged from the flame holder 116 to the turbines 108. The exhaust gas rapidly expands and thus moves at high velocity through the turbine 108. Impingement of the high-velocity exhaust gas on the turbine blades 122 causes the turbine 108 to rotate about its axis.

As the turbine 108 rotates in this manner, various events create acoustic vibrations. For example, respective acoustic vibrations are produced by the spinning compressor 104 and turbines 108. Other acoustic vibrations are produced by the ignition of the fuel in the combustor 106. The respective frequencies of these acoustic vibrations are measured using multiple microphones 124 or other transducers mounted on a water-cooled jacket of a wave-guide. The jacket and wave-guide desirably are made of a solid material having low thermal conductivity. The microphones 124 are positioned around the engine to detect different acoustic vibrations of the engine. Alternatively, one microphone can be used, depending upon the level of detail or resolution required in the vibrational data to be analyzed.

Sonic measurements performed by this embodiment are passive. Consequently, this embodiment can be made and maintained with lower cost and with greater ease than an active system. This embodiment also may avoid or at least reduce certain signal losses that otherwise can be experienced by an active system.

In an embodiment employing multiple microphones or transducers, the microphones desirably are time-synchronized for analyzing the engine's vibrations. The output of one or more of the microphones can be summed to provide sonic data useful for generating a sonogram. The sonogram can be used to visualize or otherwise to determine a dominant frequency of the acoustic vibration, various other prominent frequencies of the vibration, and data pertaining to the distribution of frequencies of the vibration.

Samples received by each microphone during a sampling period desirably are digitized using a computing device (thereby providing "digitized acoustic-vibration samples"). The digitized acoustic-vibration samples can be digitally analyzed to reveal frequency data in the samples. First, auto-correlation can be performed on each channel of data (i.e., on the respective sonic sample from each microphone) to confirm the validity of the respective data. Cross-correlation analysis can then be performed on each combination of channels to determine respective time differences of arrival (lag times) of the respective signals at each microphone or other transducer. The cross-correlation analysis also provides a way to locate and discard any cross-correlation channel in which the cross-correlation strength falls below a predetermined value. As revealed in the actual data obtained in the example described below, Applicants have discovered that the cross-correlation analysis can reveal a lag-time pattern that is unique to a particular internal characteristic of the engine, such as a particular fuel-to-air ratio.

Digitized acoustic-vibration samples also may be analyzed using any of various eigenvalue-analysis algorithms or other algorithms. One such algorithm is the Multiple Signal Classification (MUSIC) algorithm (see Appendix A). The MUSIC algorithm converts time-based digitized acoustic-vibration sample data to the frequency domain while also providing a frequency analysis or pseudo spectrum estimate. This estimate includes a dominant frequency. Other algorithms or spectrum analyses, such as visual analysis, also may be utilized depending on the volume of data and precision required in the frequency estimate. In practice, as shown in the example data below, the comparatively high precision of the MUSIC algorithm may not be necessary if it is desired merely to obtain an estimate of the pertinent frequency data.

In one embodiment, a software program loaded on a microprocessor uses auto-correlation and cross-correlation algorithms as well as the MUSIC algorithm to determine the dominant frequency of an acoustic signal from an engine. (See Appendix D.) The MUSIC algorithm is expressed by the formula:

$$P_{music}(f) = \frac{1}{e^H(f)\left(\sum_{k=p+1}^{N} v_k v_k^H\right)e(f)} = \frac{1}{\sum_{k=p+1}^{N} |v_k^H e(f)|^2}$$

in which N is the dimension of the eigenvectors and $v_k$ is the k-th eigenvector of the correlation matrix of the input signal. The integer p is the dimension of the signal subspace, so the eigenvectors $v_k$ used in the sum correspond to the smallest eigenvalues and also span the noise subspace. H is the conjugate transpose operator. (See Appendix B.) The vector e(f) consists of complex exponentials, and the inner product:

$$P_{ev}(f) = \frac{1}{\left(\sum_{k=p+1}^{N} |v_k^H e(f)|^2\right) \Big/ \lambda_k}$$

essentially amounts to a Fourier transform. This transform provides the frequency spectrum for the input signals, which in turn provides an identification of the dominant frequency of the input signals.

Applicants have found that these types of determinations can reveal or allow an estimation of the internal operating characteristics of a combustor or other region in an engine. For example, determining or estimating the dominant frequency or other prominent frequencies or frequency distributions of acoustical vibrations produced by the combustor, by the housing associated with the combustor, or by other components associated with the combustor can provide an increased understanding of the fuel-to-air ratio within the combustor.

Upon determining the dominant frequency of the turbine engine 102 (and thus data concerning the operating characteristics of the engine, such as fuel-to-air ratio), adjustments can be made to the engine as needed. Adjustments can be made any number of ways. For example, the amount of fuel supplied to the combustion zone 106 can be controlled by a mechanical or an electronic governing system 118 that uses the dominant-frequency data in a feed-back manner. Exemplary mechanical governing systems include valves and other fluid-flow-control devices. Exemplary electrical governing systems include solenoids and the like. A fuel-control system 118 controls the governing system to ensure that fuel is injected into the engine in a manner that produces and maintains an optimum fuel-to-air ratio. The fuel-control system 118 also can be configured to maintain a constant rotational speed of the engine, regardless of load applied to the engine.

Figure 3:
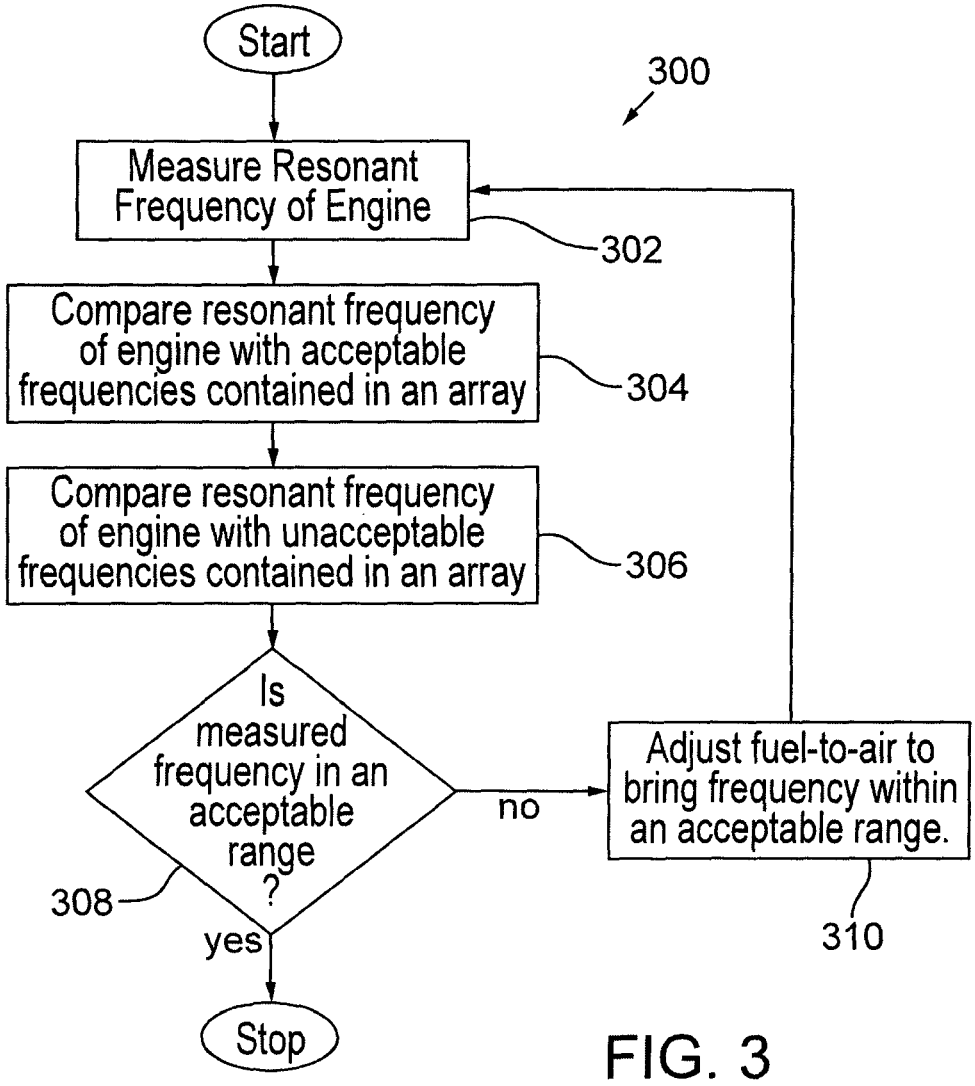
FIG. 3 is a flow chart of steps of an exemplary method for determining the fuel-to-air ratio within an engine.

With reference to FIG. 3, the software program 300 of this embodiment includes a data table of respective acoustic-signal frequencies associated with various fuel-to-air ratios. The software program receives respective acoustic data from each of multiple microphones that monitor particular respective locations in the engine and determines the respective dominant frequencies. At step 302, the software program 300 compares the determined dominant frequency(ies) for each location in the engine with the frequency data in the table. From these comparisons the software program determines, in step 304, the respective fuel-to-air ratios corresponding to the respective dominant-frequency data. From these determined fuel-to-air ratios the computing device (controlled by the software program 300) determines, in steps 306, 308, and 310, whether the fuel-to-air ratio should be adjusted to increase or decrease the amount of fuel being injected into the combustion zone 106. If the computing device determines that an adjustment is indicated, the computing device sends a control signal to the fuel pump 120 to adjust fuel intake accordingly and to the compressor 104 to adjust air intake accordingly.

In a second representative embodiment of the present invention, rather than being positioned around a ring that places all the microphones at a particular fluid-flow location of the engine, microphones are placed at various fluid-flow locations of the engine. For example, a first microphone can be placed on or near a compressor, a second microphone can be placed downstream on or near a combustor, and a third microphone can be placed further downstream on or near the turbines. The respective dominant frequencies measured at the different locations are used for determining the respective operating characteristics at the locations in the engine. The respective dominant frequencies also are used for determining whether to adjust any of various parameters that would have, if changed, an impact on those operating characteristics.

In this second embodiment, respective data from the microphones desirably are cross-correlated so as to account for respective time lags for receiving inputs at different fluid-flow locations in the engine. Thus, for example, data produced by a first microphone located at the inlet of the turbine can be used for determining the performance of the turbine overall, and data produced by a second microphone located at the output of the turbine can be used for checking the determination made by the first microphone and for determining whether the engine is performing efficiently.

With a microphone arrangement according to the second representative embodiment, for example, a first microphone located at the inlet of the turbine might detect normal acoustical vibrations caused by gas passing through the turbine, while a second microphone positioned at the outlet of the turbine might detect abnormal acoustical vibrations emanating from the combustion zone 106 of the turbine. This scenario would indicate that the compressor, operating normally, is forcing air into an abnormally operating combustor. If too much air is entering the combustor, more fuel should be added to the combustor, or the compressor should reduce the amount of air being delivered into the combustor. The time lag between the first microphone and the second microphone allows adjustments to be made to the turbine in response to the abnormal acoustical vibration being detected by the second microphone located at the combustion zone 106.

Many other scenarios are possible. For example, if acoustical vibrations emanating from the turbine are normal while acoustical vibrations emanating from the compressor are abnormal, then the system can predict possible engine failure or other operational difficulty if the compressor is not adjusted to restore the turbine to normal operating condition. In contrast, if a first microphone located at the turbine detects abnormal acoustical vibrations emanating from the turbine and a second microphone located at the combustor detects normal acoustical vibrations emanating from the combustor, then a possible problem with the turbine blades may be indicated.

In one embodiment, signals corresponding to the respective sounds detected by each microphone 124 are transferred to a computing device (not shown) for analysis. The computing device runs software that analyzes the signals from the microphones 124 to achieve one or both of the following: (i) identification (e.g., by an eigenvalue analysis as described above) of any dominant pattern in the acoustical vibrations represented by the signals; and (ii) cross-correlation of each of the signals with respective signals produced by the other microphones and a determination of correlation patterns as described above. In this embodiment, the software may contain an eigenvalue-analysis algorithm and/or a correlation algorithm (e.g., a High-Speed Time-Domain Correlator Design as described in Appendix C).

An array (e.g., data table) of reference data for dominant acoustical vibrations, representing various respective conditions of engine operation, desirably is maintained within the software or otherwise maintained in a memory of the computing device. Thus, these reference data can be readily recalled as needed for performing quick comparisons of the respective signals produced by the microphones with reference signals indicating normal operation of the engine. As in the first representative embodiment, if as-measured data are not in accord with normal-operational values, the computing system can direct appropriate adjustments of the ratio of fuel to air (or fuel to other gas, if applicable) within the combustor using any of various pumps, valves, and/or other control systems as described in the first representative embodiment.

The array of pre-determined reference data (e.g., of dominant frequencies) often reveals that the frequency range of potential interest is narrower than the entire frequency range of vibrations that may be detected by the microphones or other transducers. This situation can allow the analysis of the resulting frequency-response data to: (i) eliminate or at least reduce having to consider irrelevant or less relevant frequency-response data, (ii) reduce the complexity of the computational or analytical resource used for performing data analysis, (iii) increase the rate while reducing the cost of data processing, and (iv) reduce the probability of considering interfering noise in the calculations.

EXAMPLE 1

Figure 4:
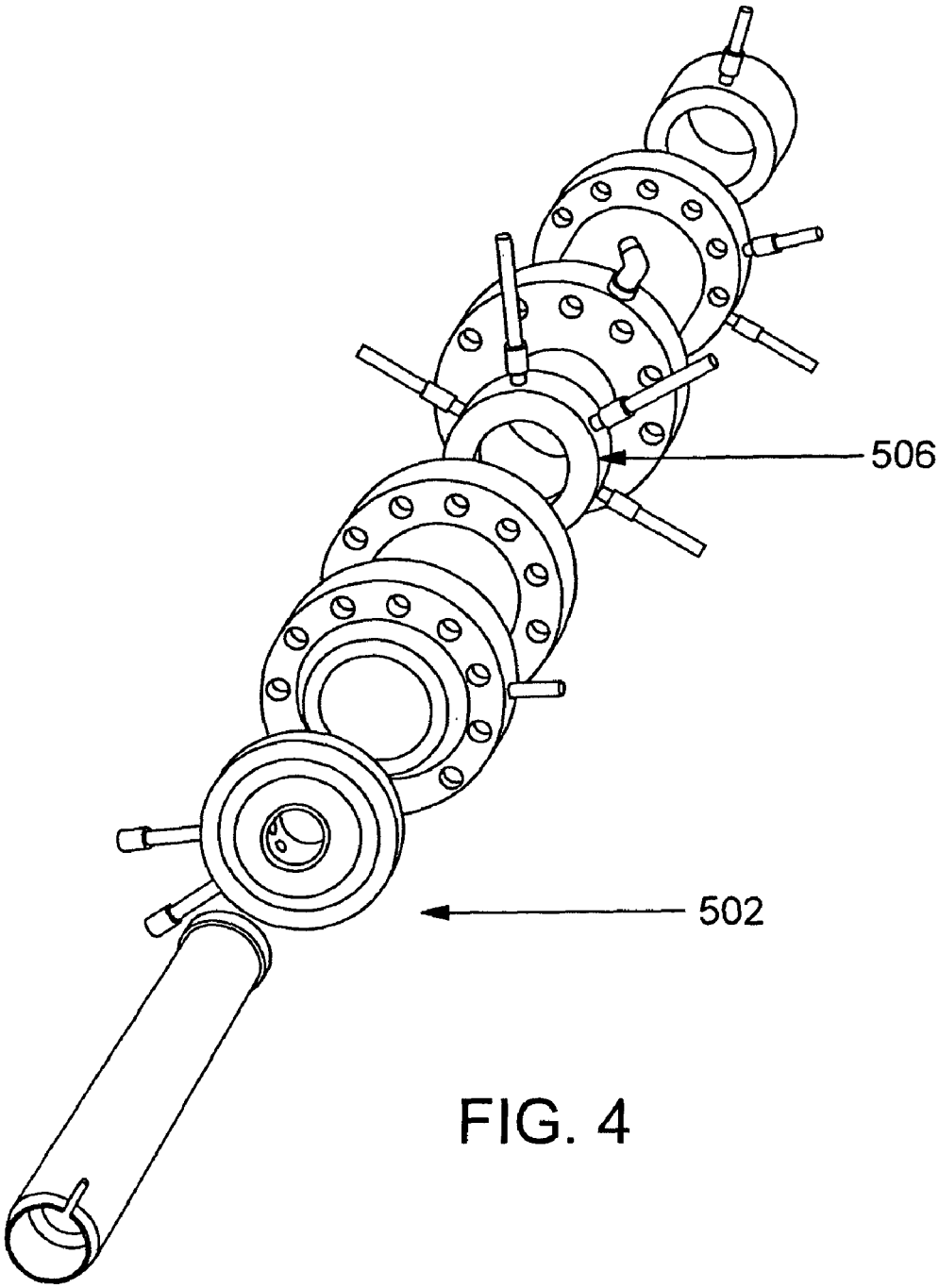
FIG. 4 is an exploded view of a burner rig used in the example described herein.
Figure 5:
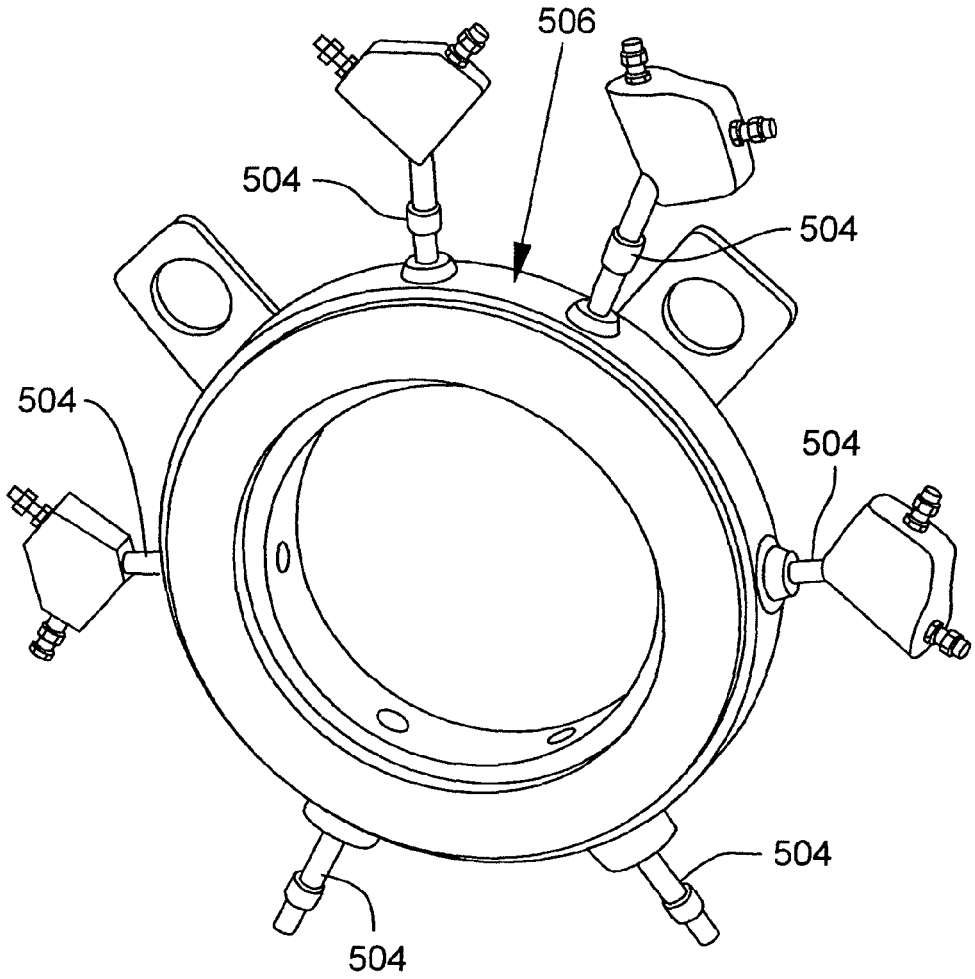
FIG. 5 depicts a ring of the burner rig of FIG. 4.
Figure 6A:
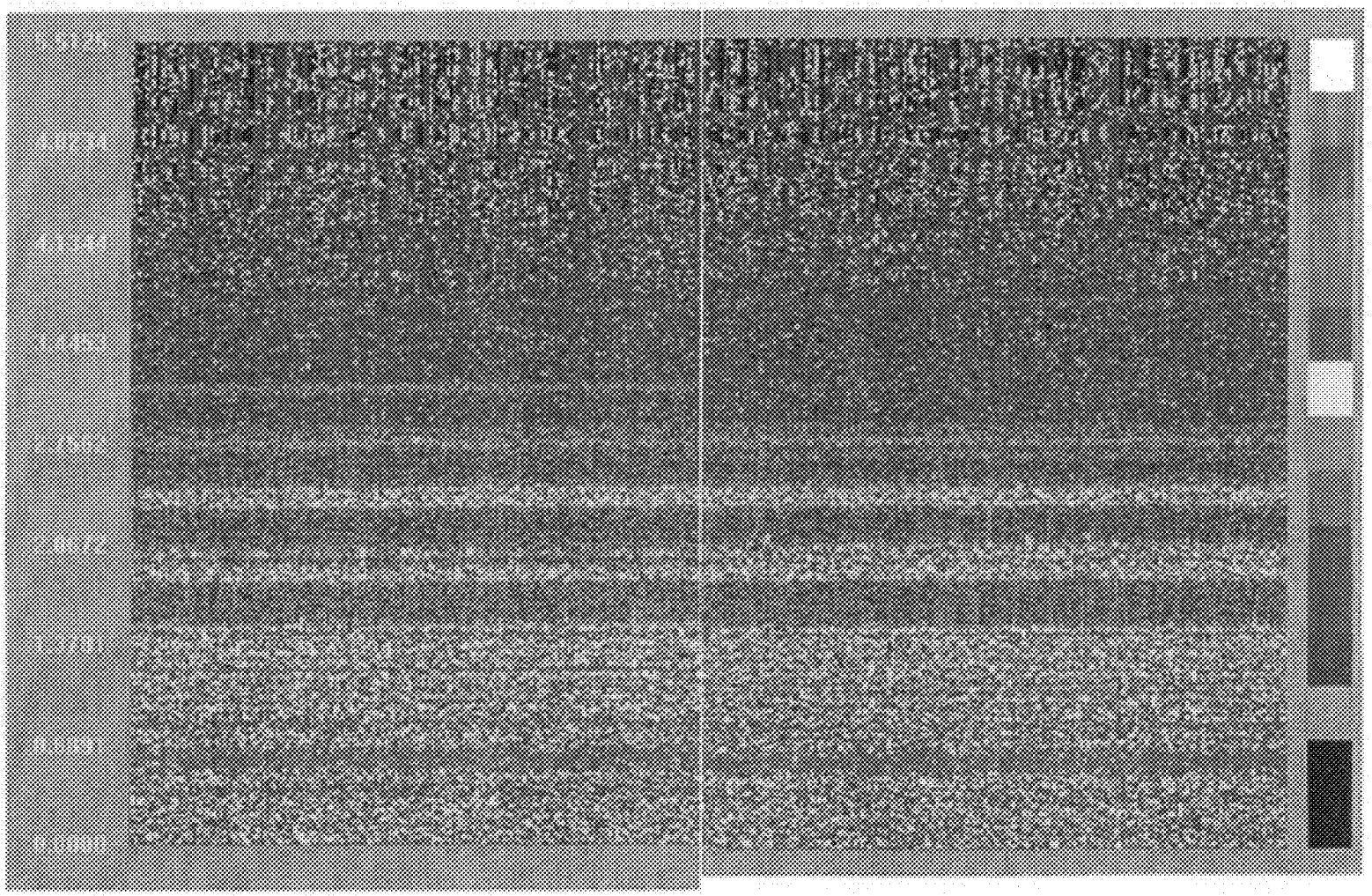
FIGS. 6A-6D are exemplary sonograms obtained from a combustor operating at fuel-to-air ratios of 0.035, 0.045, 0.055, and 0.065, respectively, as described in Example 1. See also Appendix D.
Figure 6B:
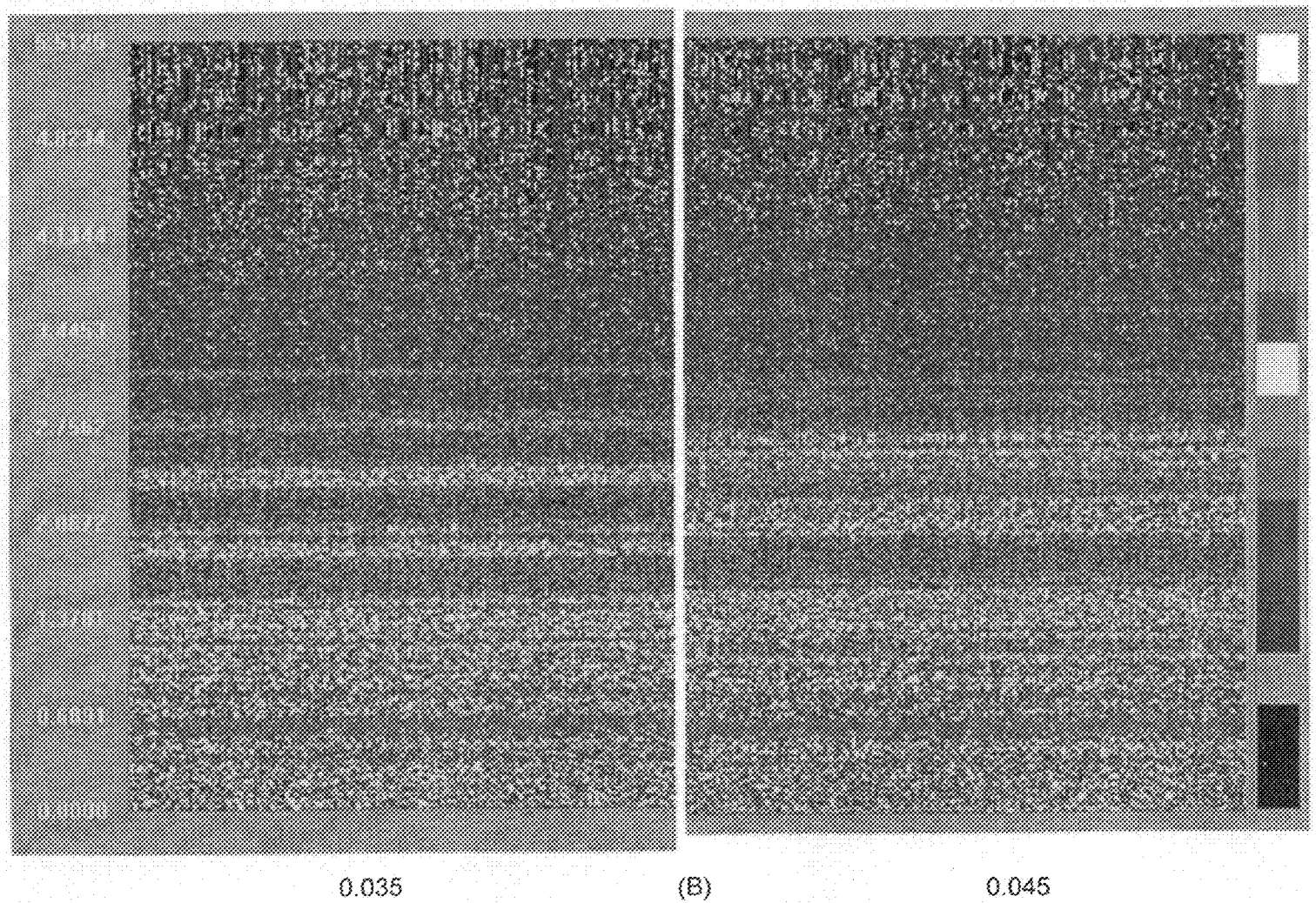
Figure 6C:
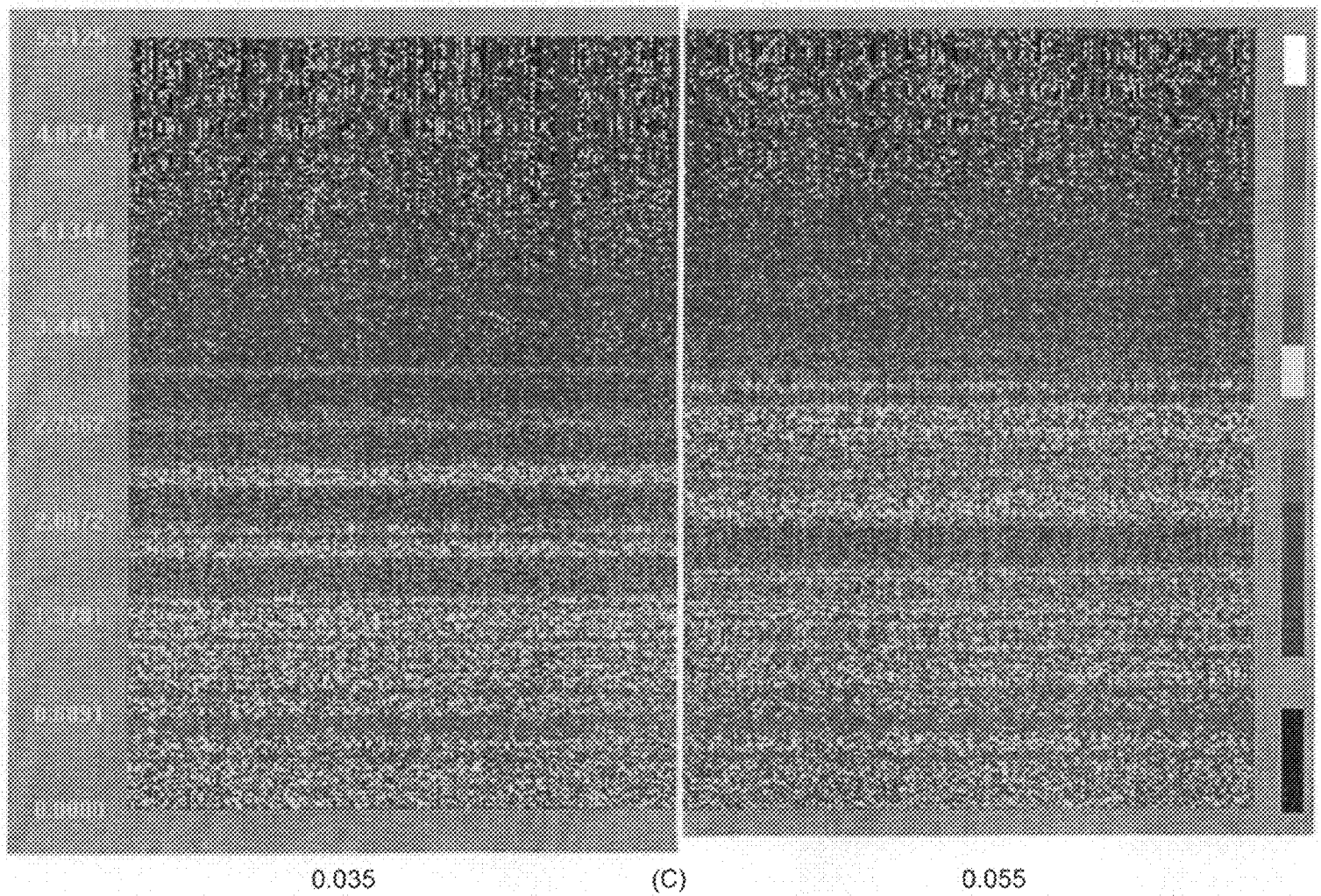
Figure 6D:
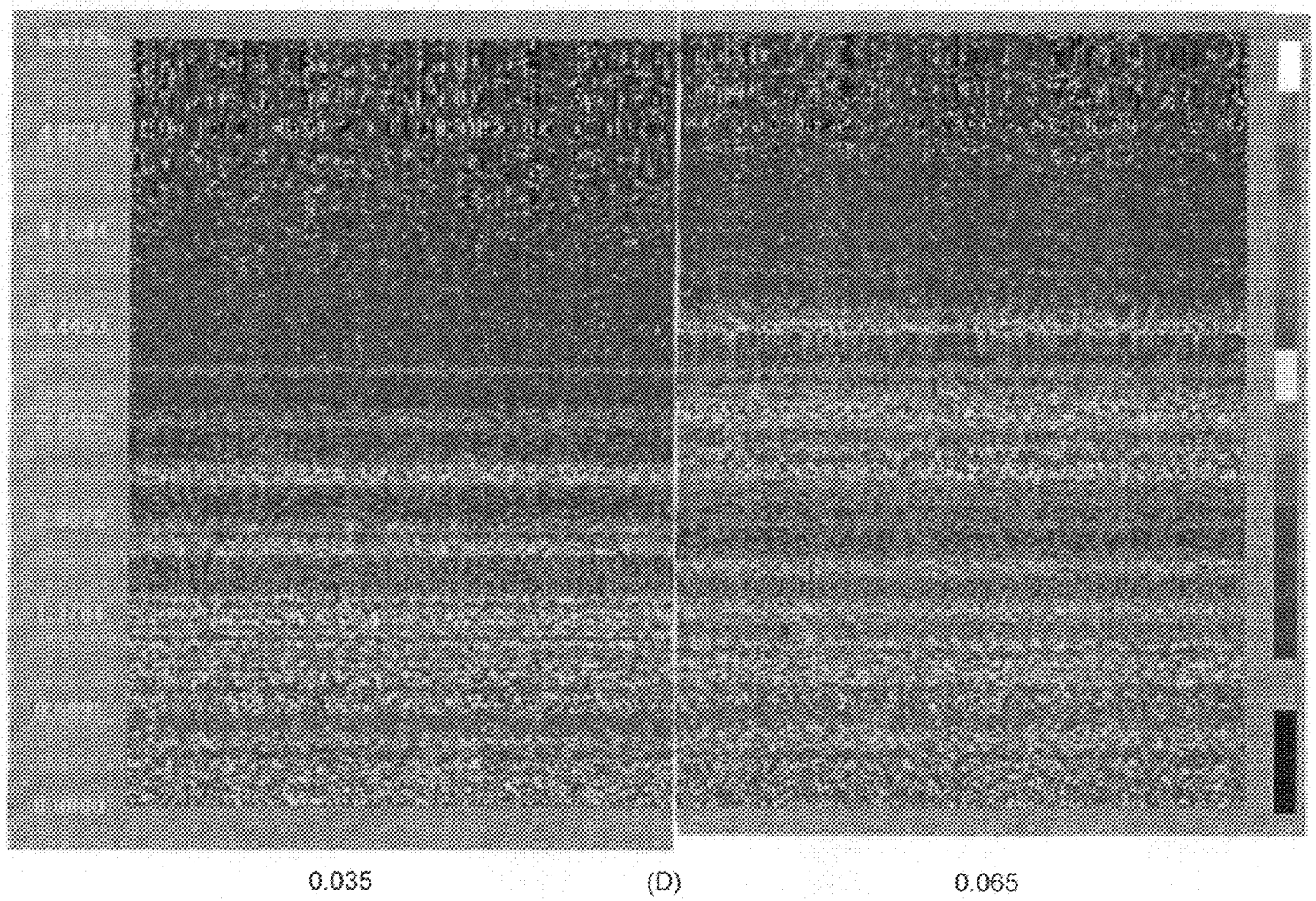
Figure 7:
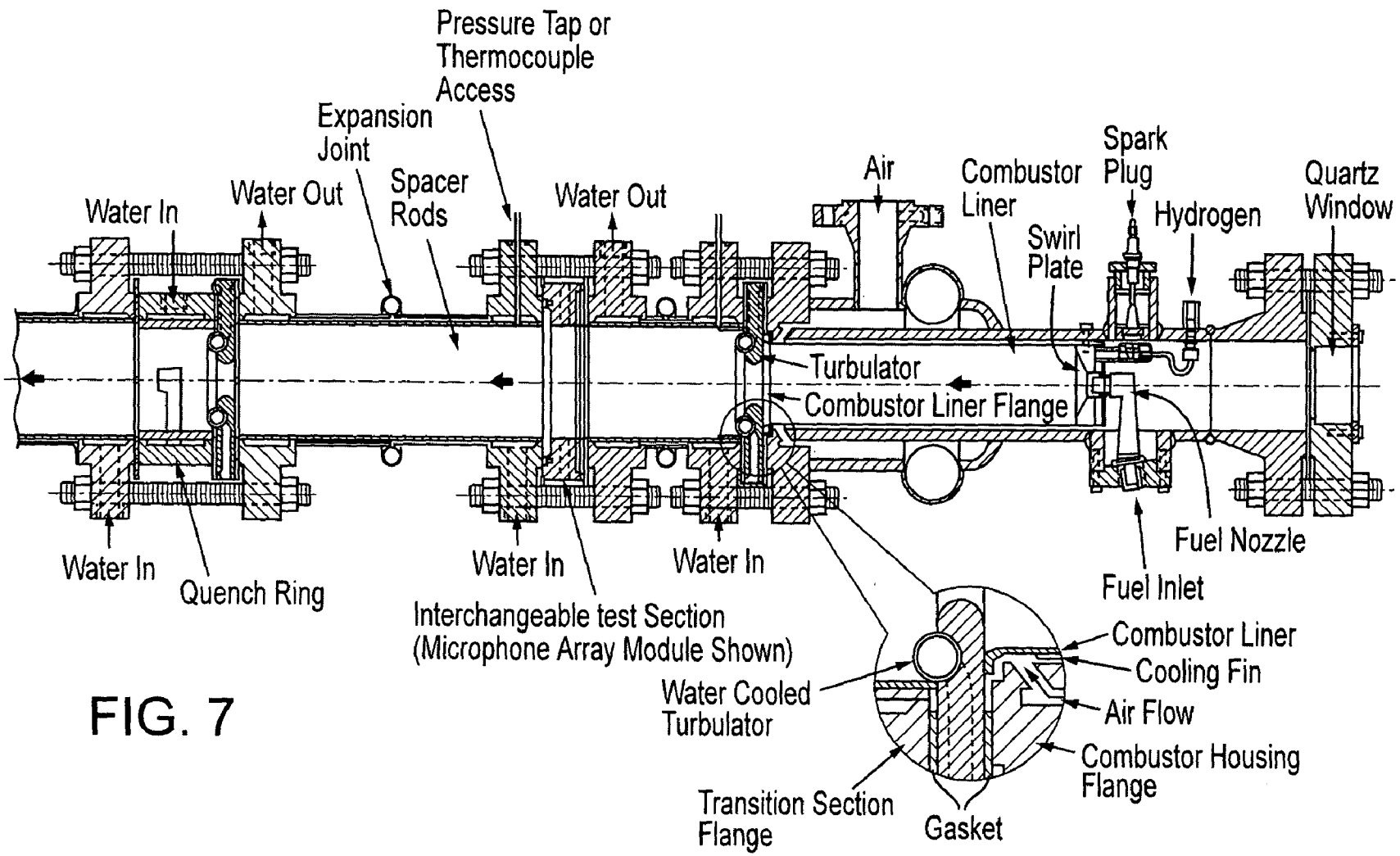
FIG. 7 is a cross-sectional view of an exemplary high-pressure burner turbine used for generating the sonograms of FIGS. 6A-6D.
Figure 8:
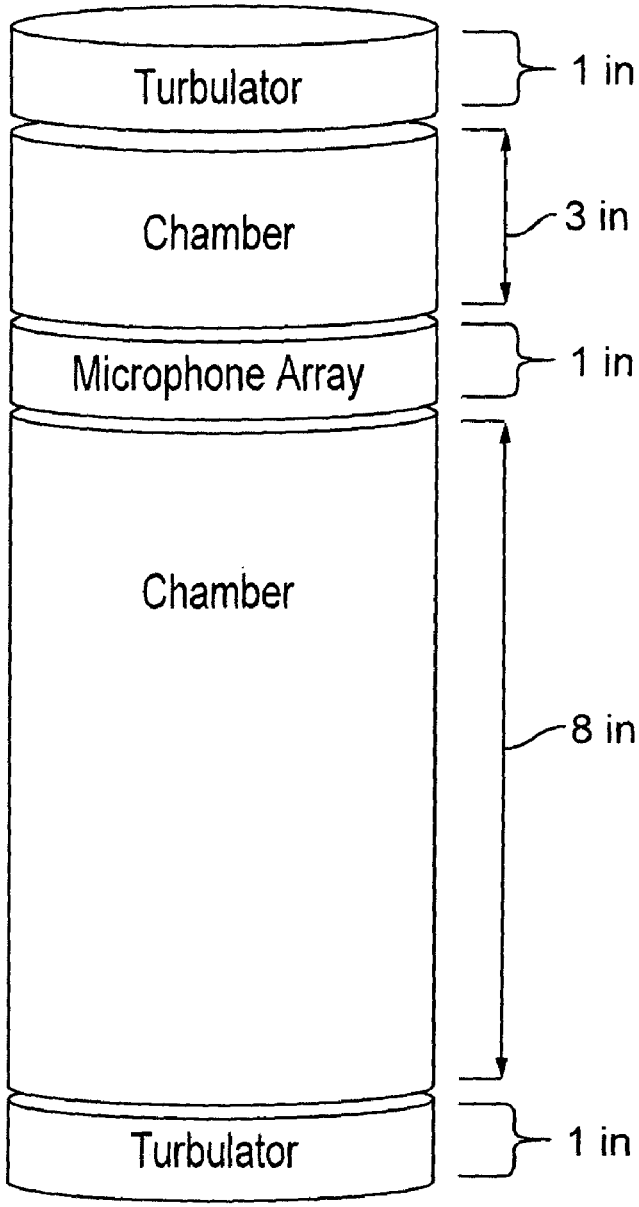
FIG. 8 is a schematic diagram of microphone placement laterally along the interchangeable test section in the turbine shown in FIG. 7 (see Appendix D).
Figure 9:
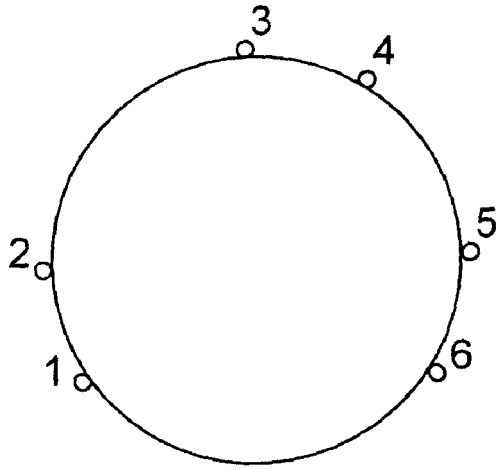
FIG. 9 is a schematic diagram showing microphone placement around the circumference of the interchangeable test section shown in FIGS. 7 and 8 (see Appendix D).

Using an example turbine operating under various conditions, the exemplary characteristic of fuel-to-air ratio was monitored experimentally. The turbine was a High-Pressure Burner Rig 502 ("HPBR") as shown in FIG. 5. To the HPBR 502 were mounted six acoustic transducers (piezo pressure transducers used as microphones) 504 around a ring 506 of the HPBR (see FIG. 4). The ring 506 was positioned just downstream of a combustion zone of the HPBR 502 to allow the transducers to measure the combustion noise. The transducers were of a special configuration that eliminated ground loops. They also were wide-band and rated for operation at temperatures up to 500° C. Since combustion temperatures were much higher than 500° C., the transducers were offset at an angle relative to the combustion flame, and dry nitrogen gas was used as a cooling buffer.

Data from the transducers were recorded using a Sony sixteen-channel digital recorder having a capability for storing time and date information used for synchronizing the data. A control-room clock was synchronized at the beginning of the test. Six channels of the recorder were used, with each channel being a respective input from a respective transducer. The transducers were mounted in a water-cooled jacket and inserted into the combustor flow path where the sample normally would be located. Each microphone was plumbed for nitrogen gas supplied by a ¼-inch fitting. The six transducers required a charge amplifier for each channel, and the charge amplifiers were powered by a power supply. The data recorder was powered by the same isolation amplifier as the charge amplifiers.

During operation of the HPBR 502, the digital data recorder was used to monitor respective acoustic frequencies, emanating from the HPBR 502, received by the transducers 504. The fuel-to-air ratio being delivered to the HPBR 502 was then altered at various times over several hours to produce different operating conditions of the HPBR under which data were obtained.

To obtain a graphic depiction of acoustic frequencies produced by the HPBR 502 under the various operating conditions, the output signals of the six acoustic transducers 504 were gain-equalized and summed into a single channel of the data recorder, and sonograms were produced from the summed data. The sonograms were in form of time-frequency plots of the summed inputs, and were printed at stable fuel/air mixtures for fuel/air ratios of 0.035, 0.045, 0.055, and 0.065 are shown in FIGS. 6A-6D, respectively. In these sonograms, the range from weakest (lowest amplitude) to strongest (greatest-amplitude) frequency is indicated by colors, with red being the strongest, yellow being weaker than red, green being weaker than yellow, and blue being weaker than yellow.

Comparisons of the sonograms at each of the stable set points shows not only consistency of the data from one time record capture to the next, but also (and more importantly) that there was an observable difference in the frequency and amplitude content from one set-point value to the next.

The sonograms of FIGS. 6A-6D indicate increases in higher dominant frequencies with corresponding increases in the fuel-to-air ratio. The sonograms also show respective distinctive relative frequency prominence and frequency distribution for each fuel-to-air ratio. The sonograms also show that the dominant frequency of all tested fuel-to-air ratios fell within a range centered at approximately 700 Hz. Consequently, for an assessment of an engine in which the fuel-to-air ratios shown in FIGS. 6A-6D reflect the full range of fuel-to-air ratio that is of concern, the analysis can be limited to frequency data that are within the approximately 700-Hz range of the dominant frequencies shown in FIGS. 6A-6D.

Auto-correlation analysis of the transducer data yielded cosine waveforms. Cross-correlation performed between all possible combinations of the transducers showed that finite time delays occurred between the transducers. Also, a multiple signal classification (MUSIC) algorithm was applied to the data from each transducer. The MUSIC algorithm estimated the pseudo-spectrum of the signal. The algorithm performed eigenspace analysis of the signal's correlation matrix to estimate the signal's frequency content. This algorithm was particularly suitable for this data, which is narrow-band in nature and exhibits dominant frequencies.

This example also shows that a determination or estimation of the dominant frequency or other frequency data or frequency relationships for a given combustor can provide an indication of the fuel-to-air ratio being delivered to a given combustor. This indication is provided by reference to a predetermined data table or data array in which various disparate dominant frequencies or other frequency data are respectively associated with respective disparate fuel-to-air ratios. The frequency data or relationships can include harmonics of other frequencies in the resulting frequency data or sonogram.

Further details regarding this example, the apparatus used in connection with it, and various other representative embodiments are set forth in the attached Appendix D. The MUSIC analysis performed as reported in Appendix D, for example, confirms that an estimated dominant frequency can provide a direct indication of the fuel-to-air ratio within the combustor of the engine.

Although the foregoing example confirmed the use of acoustic-frequency data and/or cross-correlation data for determining fuel-to-air ratios in a combustor such as a turbine, aspects of these techniques may be utilized to determine other engine-operational characteristics in similar or other environments. For example, the techniques may be utilized for determining burn rates in furnaces, water-to-air rates in boilers, flow rates in steam or other engines, center-of-energy or fissure determinations in a turbine or other engine, temperatures of internal cavities in an engine, dangerous engine-operating conditions, etc.

To use these techniques for determining flow rates in an engine, microphones or other transducers can be spaced along the length of a portion of the engine in which the flow rate of exhaust, steam, or other moving substance is to be determined. Cross-correlation analysis may be utilized to obtain flow data for the moving substance.

To use these techniques for determining the center of energy or a possible fissure in a turbine engine, for example, microphones or other transducers can be placed around the circumference of the combustor chamber at, for example, a pre-determined distance from the fuel-combustor nozzle. Thus, the microphones or transducers are placed within a plane that is transverse to the axis of the combustor chamber. Differences in frequency data from one microphone or transducer to the next can indicate flame-out of a particular fuel nozzle, development of a fissure in the chamber, or location of the center of energy of the exhaust flow through the chamber too close to the chamber wall where damage to the chamber wall could occur.

EXAMPLE 2

This example is similar to Example 1 in the use of six transducers (microphones) disposed around the burner rig described above.

Auto-correlation was performed on each channel of data (each sonic sample from each transducer) to confirm data validity. Cross-correlation analysis was then performed on each channel combination to determine the time difference of arrival (lag) of signals at each transducer. In addition, the cross-correlation analysis provided a means of locating and discarding any cross-correlation channel in which the cross-correlation strength falls below a predetermined value. Cross-correlations having strength below a predetermined value were discarded. The results for 20 attempts are shown in Table 1 (frequency: 2:5-23000 Hz):

TABLE 1

| | Cross-correlation Results | | | | | | | | | | | | | | |
|---|---|---|---|---|---|---|---|---|---|---|---|---|---|---|---|
| set | 1 & 2 | 1 & 3 | 1 & 4 | 1 & 5 | 1 & 6 | 2 & 3 | 2 & 4 | 2 & 5 | 2 & 6 | 3 & 4 | 3 & 5 | 3 & 6 | 4 & 5 | 4 & 6 | 5 & 6 |
| 1 | −5 | −1 | 9 | 1 | 0 | 1 | 18 | 6 | 2 | 10 | 3 | 0 | −2 | −12 | −3 |
| 2 | −3 | −3 | ### | 2 | 1 | 1 | 15 | 7 | 2 | 6 | 3 | 0 | −1 | −8 | −3 |
| 3 | −3 | −2 | 13 | 2 | 1 | 1 | 19 | 7 | 2 | 6 | 3 | 0 | −1 | −11 | −4 |
| 4 | −4 | −3 | ### | 1 | −1 | 1 | 19 | 7 | 2 | 10 | 3 | −1 | −1 | −11 | −4 |
| 5 | −2 | ### | ### | ### | ### | ### | ### | ### | ### | 7 | 3 | 0 | −2 | −10 | −3 |
| 6 | −4 | ### | ### | ### | ### | ### | ### | ### | ### | 8 | ### | ### | ### | ### | −4 |
| 7 | −5 | ### | ### | ### | ### | ### | ### | ### | ### | 4 | ### | ### | ### | ### | −3 |
| 8 | −4 | ### | ### | ### | ### | ### | ### | ### | ### | 9 | ### | ### | ### | ### | −3 |
| 9 | −4 | ### | ### | ### | ### | ### | ### | ### | ### | 8 | ### | ### | ### | ### | −4 |
| 10 | −3 | ### | ### | ### | ### | ### | ### | ### | ### | 4 | ### | ### | ### | ### | −4 |
| 11 | −4 | ### | ### | ### | ### | ### | ### | ### | ### | 7 | ### | ### | ### | ### | −3 |
| 12 | −5 | ### | ### | ### | ### | ### | ### | ### | ### | 3 | ### | ### | ### | ### | −3 |
| 13 | −3 | ### | ### | ### | 2 | ### | ### | 9 | 3 | 4 | ### | ### | ### | ### | −3 |
| 14 | −4 | ### | ### | 2 | 1 | ### | ### | 7 | 2 | 8 | ### | ### | ### | ### | −4 |
| 15 | −4 | ### | ### | 0 | 0 | ### | ### | 8 | 2 | 5 | ### | ### | ### | ### | −4 |
| 16 | −3 | ### | ### | 2 | 1 | ### | ### | 8 | 2 | 7 | ### | ### | ### | ### | −3 |
| 17 | −6 | ### | ### | 1 | −1 | ### | ### | 8 | 2 | 5 | ### | ### | ### | ### | −4 |
| 18 | −4 | ### | ### | ### | ### | ### | ### | ### | ### | 6 | ### | ### | ### | ### | −4 |
| 19 | −3 | ### | ### | ### | ### | ### | ### | ### | ### | 5 | ### | ### | ### | ### | −4 |
| 20 | −5 | ### | ### | ### | ### | ### | ### | ### | ### | 6 | ### | ### | ### | ### | −3 |
| avg | −3.9 | −2.25 | 11 | 1.375 | 0.444 | 1 | 17.75 | 7.444 | 2.111 | 6.4 | 3 | −0.25 | −1.25 | −10.5 | −3.5 |
| stdv | .968 | .957 | 2.828 | .744 | 1.014 | 0 | 1.893 | .882 | .333 | 2.01 | 0 | 0.5 | 0.5 | 1.732 | .513 |
| std % | 24.82 | 42.55 | 25.71 | 54.11 | 228.1 | 0 | 10.66 | 11.85 | 15.79 | 31.41 | 0 | 200 | 40 | 16.5 | 14.66 |

The discarded cross-correlations are denoted by ###. The standard deviations for the valid cross-correlations at a give fuel air ratio were as high as 40%.

A spectrum analysis of each transducer output was performed. The digitized acoustic-vibration samples were analyzed using the MUSIC algorithm, which converts time-based digitized acoustic-vibration sample data to the frequency domain and provides a frequency analysis or pseudo-spectrum estimate that includes the dominant frequency. The dominant frequency for each transducer was noted. The frequency of each transducer was averaged over a ten-second period. Table 2 shows how distinctly different the frequencies were for each fuel/air ratio. An additional set of fuel/air ratio measurements were taken after the combustor had cycled through its performance duty cycle (approximately one-half hour). Table 3 shows the repeatability of the frequency pattern. The standard deviations for a given fuel/air ratio were approximately 1% or less.

TABLE 2

| | Dominant Frequencies | | | | | |
|---|---|---|---|---|---|---|
| Fuel/air | Mic 1 | Mic 2 | Mic 3 | Mic 4 | Mic 5 | Mic 6 |
| 0.035 | 591.00 | 599.55 | 596.50 | 621.20 | 588.20 | 586.15 |
| 0.045 | 605.30 | 607.85 | 620.10 | 629.80 | 606.95 | 596.85 |
| 0.055 | 613.45 | 615.70 | 639.50 | 640.55 | 622.10 | 608.75 |
| 0.065 | 619.40 | 621.10 | 662.60 | 647.90 | 667.50 | 617.55 |

TABLE 3

| | Dominant Frequencies (30 min later) | | | | | |
|---|---|---|---|---|---|---|
| Fuel/air | Mic 1 | Mic 2 | Mic 3 | Mic 4 | Mic 5 | Mic 6 |
| 0.035 | 595.10 | 599.85 | 599.00 | 622.80 | 603.15 | 589.00 |
| 0.045 | 607.10 | 608.95 | 620.75 | 631.75 | 617.50 | 597.40 |
| 0.055 | 613.45 | 614.95 | 632.75 | 637.90 | 630.55 | 604.40 |
| 0.065 | 620.75 | 621.00 | 664.15 | 647.75 | 665.65 | 617.65 |

Making an assumption that the dominant frequencies were resonant frequencies, the dominant frequencies were converted to temperatures using the relationship between the speed of sound and temperature:

$$f_n=[(2n-1)cJ/4L$$

in which:

n=nth harmonic (n is a positive integer)

L=effective length ($L^1$+0.85 D), in meters (m)

$L^1$=passage length, in meters (m)

D=diameter, in meters (m)

$c=(\gamma/RT_k/m)^{1/2}$, in m/s $\gamma$=ratio of specific heats

R=gas constant, 8.314 J/mole-K m=molecular weight, kg/mole $T_k$=temperature, K

The temperatures were then used to generate an isothermal map.

Another experiment was conducted using the same test rig but outfitted with a set of four thermocouples that were rotated around the circumference of the exit annulus plane of the combustor. This temperature-sensor configuration was used to determine the temperature distribution at the exit plane and burner-pattern factor of the combustor. Acoustic transducers were applied to the test rig and data taken as the temperature sensor was moved about the circumference of the exit plane of the combustor. Preliminary analysis of the obtained data appeared to confirm the aforementioned relationship between frequency and fuel/air ratio.

Although the examples and other embodiments disclosed above utilize passive techniques of vibration detection and analysis, active analysis alternatively or also may be utilized to further enhance or expand the amount of data that is obtained concerning engine operation.

What is claimed is:

1. A device for determining an internal performance characteristic of an engine during operation of the engine, the device comprising:

at least one vibration detector configured to be situated relative to the engine so as to receive and detect vibrations emanating from the engine during operation of the engine, the at least one vibration detector being configured to produce corresponding electrical signals upon receiving and detecting the vibrations;

a memory in which data is stored pertaining to frequency of vibrational emanations associated with the internal performance characteristic under various conditions; and a controller coupled to the at least one vibration detector and the memory, the controller being configured (i) to receive the electrical signals from the at least one vibration detector, (ii) to determine, from the received electrical signals, at least one diagnostic frequency of the vibrations, (iii) to compare the determined at least one diagnostic frequency with the data in the memory, and (iv) to produce a measurement of the internal performance characteristic based on the comparison.

2. The device of claim 1, wherein the vibrations are acoustic vibrations.

3. The device of claim 2, wherein the controller is further configured to produce a sonogram based on the received electrical signals.

4. The device of claim 2, wherein the at least one vibration detector comprises at least one microphone.

5. The device of claim 1, wherein the diagnostic frequency is a dominant frequency.

6. The device of claim 1, further comprising a feedback-control device coupled to the engine and to the controller, the feedback-control device being configured to control, responsively to the controller, at least one of supply of fuel to the engine and supply of air to the engine so as to regulate a condition of combustion of the fuel and air in the engine.

7. The device of claim 6, wherein the feedback-control device is configured to adjust a fuel-to-air ratio in the engine.

8. The device of claim 1, wherein the controller is further configured, after producing a measurement of the internal performance characteristic, to adjust an operating parameter of the engine as indicated by the measurement.

9. The device of claim 1, wherein the at least one vibration detector comprises at least one acoustic-pyrometry transducer.

10. The device of claim 9, wherein the at least one acoustic-pyrometry transducer is selected from the group consisting of active and passive acoustic-pyrometry transducers.

11. The device of claim 1, wherein the at least one vibration detector comprises multiple vibration detectors each placed at a respective location relative to the engine, each vibration detector being configured to produce respective vibration data encoded in the respective electrical signals.

12. The device of claim 1, wherein:

each vibration detector is a respective acoustic-vibration detector; and each acoustic-vibration detector is configured to produce respective electrical signals encoding respective sonic data corresponding to the respective location.

13. The device of claim 12, wherein the multiple acoustic-vibration detectors are time-synchronized relative to each other.

14. The device of claim 12, wherein the controller is configured to perform auto-correlation of the respective electrical signals received from the multiple acoustic-vibration detectors during a predetermined sampling period so as to confirm validity of respective sonic data produced by the acoustic-vibration detectors.

15. The device of claim 14, wherein the controller is further configured to sum the sonic data produced by the acoustic-vibration detectors and to produce a sonogram from the summed sonic data.

16. The device of claim 15, wherein the controller is further configured to determine, from the sonogram, one or more of (a) a dominant frequency of the acoustic vibration, (b) other prominent frequencies of the acoustic vibration, and (c) a distribution of frequencies of the acoustic vibration.

17. The device of claim 11, wherein the controller is configured to perform a cross-correlation of vibration data from each combination of vibration detectors to determine respective time differences of arrival of the vibration data from the engine to the respective vibration detectors.

18. The device of claim 17, wherein the cross-correlation analysis is performed so as to reveal a lag-time pattern of the vibrations that is unique to the internal performance characteristic.

19. The device of claim 17, wherein:

the engine comprises a combustor; and the controller is further configured to utilize the cross-correlation analysis to assess a fuel-to-air ratio in the combustor.

20. The device of claim 11, wherein:

the respective electrical signals produced by each vibration detector are analog signals; and the controller comprises an analog-to-digital converter configured to digitize the respective electrical signals from the vibration detectors.

21. The device of claim 20, wherein the controller is further configured to analyze the digitized signals using an eigenvalue-analysis algorithm.

22. The device of claim 21, wherein the eigenvalue-analysis algorithm is a multiple-signal-classification algorithm.

23. The device of claim 22, wherein the controller is further configured to identify, using the multiple-signal-classification algorithm, a dominant frequency among various vibrations detected by the vibration detectors.

24. The device of claim 23, wherein:

the engine comprises a combustor; and the controller is further configured to determine, from the identified dominant frequency, a fuel-to-air ratio in the combustor.

25. The device of claim 1, wherein:

the engine comprises at least one combustor;

the data in the memory include data concerning pre-determined one or more pre-determined frequency emanations from a combustor of a similar engine operating under defined operating conditions; and the controller is further configured to compare at least one respective frequency emanating from at least one combustor to the corresponding data in the memory.

26. The device of claim 25, wherein the data in the memory includes respective diagnostic frequencies associated with a plurality of possible fuel-to-air ratios for the at least one combustor.

27. The device of claim 1, wherein:

the engine comprises at least one combustion zone and a fuel pump;

the at least one vibration detector comprises multiple acoustic-vibration detectors for detecting acoustic vibrations emanating from respective monitored locations relative to the at least one combustion zone; and the controller is further configured (a) to compare the determined at least one diagnostic frequency for each monitored location with frequency data in the memory, (b) to determine, from the comparisons, respective fuel-to-air ratios corresponding to the respective diagnostic-frequency data, (c) to determine whether the fuel-to-air ratio being delivered to the at least one combustion zone should be changed in response to the determined diagnostic frequency, and (d) if a change in the fuel-to-air ratio is indicated, to route a control signal to the fuel pump to adjust an amount of fuel being delivered to the at least one combustion zone.

28. The device of claim 1, wherein:

the engine comprises a combustion zone; and the device comprises multiple vibration detectors situated around a ring corresponding to a same-fluid-flow location of the engine.

29. The device of claim 1, wherein:

the engine comprises a combustion zone; and the device comprises multiple vibration detectors situated at different fluid-flow locations of the engine.

30. A device for determining an internal performance characteristic of an engine during operation of the engine, the device comprising:

vibration-detection means for receiving and detecting vibrations emanating from the engine during operation of the engine and for producing corresponding electrical signals based on the received and detected vibrations;

memory means for storing pre-determined frequency data of vibrational emanations associated with the internal performance characteristic under various conditions;

data-calculation means for receiving the electrical signals from the vibration-detection means, and for determining, from the received electrical signals, at least one diagnostic frequency of the vibrations;

data-comparing means for comparing the determined diagnostic frequency with the pre-determined data in the memory means; and measurement-determination means for producing, based on the comparison performed by the data-comparing means, a measurement of the internal performance characteristic.

31. The device of claim 30, wherein the diagnostic frequency is a dominant frequency.

32. The device of claim 30, wherein the vibration-detection means comprises acoustic-vibration-detection means.

33. The device of claim 32, wherein the acoustic-vibration-detection means comprises multiple microphones arranged at a particular fluid-flow location of the engine.

34. The device of claim 32, wherein the acoustic-vibration-detection means comprises multiple microphones situated at different respective fluid-flow locations of the engine.

35. The device of claim 30, wherein:

the memory means, data-calculation means, data-comparing means, and measurement-determination means are respective portions of a computer means; and the device further comprises feedback-control means for regulating a fuel-to-air ratio of the mixture based on the measurement of the internal performance characteristic performed by the computer means.

36. The device of claim 30, wherein:

the engine is an internal combustion engine comprising at least one combustor means in which a mixture of fuel and air is combusted;

the internal performance characteristic pertains to a combustion condition in the combustor; and the device further comprises feedback-control means for regulating a fuel-to-air ratio of the mixture based on the measurement of the internal performance characteristic.

37. The device of claim 36, wherein:

the feedback-control means comprises fuel-pump means for delivering fuel to the combustor; and the feedback-control means, responsively to the comparison, regulates a rate at which the fuel-pump means delivers fuel to the combustor so as to regulate the fuel-to-air ratio.

38. The device of claim 30, wherein:

the vibration-detection means comprises multiple vibration detectors situated at respective locations on or in the engine;

the memory means, data-calculation means, data-comparing means, and measurement-determination means comprise respective portions of a recording-and-computing means to which the vibration detectors are connected; and the recording-and-computing means analyzes the respective electrical signals produced by the vibration detectors by a signal-classification or signal-assessment algorithm.

39. A device for controlling, in a combustor, a ratio between a fuel and an oxidizer substance used for producing combustion in the combustor, the device comprising:

at least one acoustic-vibration detector configured to be situated relative to the combustor so as to receive and detect vibrations emanating from the combustor while combustion is occurring in the combustor, the at least one vibration detector being configured to produce corresponding electrical signals upon receiving and detecting the vibrations;

a memory in which a data array is stored, the data array comprising frequency data of vibrational emanations associated with a particular internal-combustion characteristic of the combustor under various conditions;

a computer coupled to the memory and to the at least one vibration detector so as to receive the electrical signals, the computer being configured (i) to determine, from the received electrical signals, at least one diagnostic frequency of the vibrations, (ii) to compare the calculated diagnostic frequency with the data array, (iii) to produce a measurement of the internal performance characteristic based on the comparison, and (iv) based on the measurement, determine a ratio between fuel and oxidizer substance in the combustor; and a feedback-control device coupled to the computer and to the combustor, the feedback-control device being configured to control, responsively to the ratio determined by the computer, supply of at least one of fuel and oxidizer substance to the combustor so as to regulate a condition of combustion of the fuel and oxidizer substance in the combustor.

40. The device of claim 39, wherein the diagnostic frequency is a dominant frequency.

41. The device of claim 39, wherein the at least one vibration detector is a respective at least one acoustic-vibration detector.

42. The device of claim 41, wherein the at least one acoustic-vibration detector is a respective at least one acoustic-pyrometry detector.

43. The device of claim 39, wherein the at least one vibration detector is situated downstream of a source of vibration in the combustor.

44. The device of claim 39, further comprising a data-storage device, coupled to the computer, for storing data corresponding to the measurements of the internal performance characteristic.

45. The device of claim 39, wherein the computer comprises a comparator configured to compare the determined diagnostic frequency with corresponding frequency data in the array.

46. A method for determining an internal performance characteristic of an engine during operation of the engine, the method comprising the steps of:

detecting vibrations emanating from the engine during operation of the engine;

producing electrical signals corresponding to the detected vibrations;

determining from the electrical signals at least one diagnostic frequency of the vibrations;

comparing the determined at least one diagnostic frequency with pre-existing data pertaining to frequency of vibrational emanations associated with the internal performance characteristic under various conditions; and producing a measurement of the internal performance characteristic based on the comparison.

47. The method of claim 46, wherein the step of detecting vibrations further comprises detecting acoustic vibrations.

48. The method of claim 46, wherein the step of determining the diagnostic frequency further comprises determining a dominant frequency.

49. The method of claim 46, wherein:

the engine comprises at least one combustor including a location from which the vibrations emanate; and the step of detecting the vibrations further comprises detecting the vibrations emanating from the location.

50. The method of claim 46, wherein the step of comparing the at least one diagnostic frequency with pre-existing data further comprises comparing the at least one diagnostic frequency with data pertaining to respective prominent frequencies of vibrational emanations associated with various fuel-to-air ratios entering the combustor.

51. A method for controlling an internal-combustion engine during operation of the engine, the method comprising the steps of:

supplying a mixture of fuel and air to the engine as the engine is operating;

detecting vibrations emanating from the engine during operation of the engine;

producing electrical signals corresponding to the detected vibrations;

determining from the electrical signals at least one diagnostic frequency of the vibrations;

comparing the determined at least one diagnostic frequency with pre-existing data pertaining to frequency of vibrational emanations associated with the internal performance characteristic under various conditions;

producing a measurement of the internal performance characteristic based on the comparison; and based on the measurement, changing a fuel-to-air ratio of the mixture being supplied to the engine.

52. The method of claim 51, wherein the step of detecting vibrations further comprises detecting acoustic vibrations.

53. The method of claim 52, wherein producing the step of producing the measurement further comprises producing a sonogram from the detected acoustic vibrations.

54. The method of claim 51, wherein the step of determining at least one diagnostic frequency further comprises determining a dominant frequency.

55. The method of claim 51, wherein:

the engine comprises at least one combustor including a location from which the vibrations emanate; and the step of detecting the vibrations further comprises detecting the vibrations emanating from the location.

56. The method of claim 51, wherein the step of changing a fuel-to-air ratio further comprises changing said ratio by feedback control, based on the measurement, in real time as the engine is operating.

* * * * *